US012768548B2

(12) United States Patent
Park et al.

(10) Patent No.: US 12,768,548 B2
(45) Date of Patent: Oct. 20, 2026

(54) DEHUMIDIFIER

(71) Applicant: LG ELECTRONICS INC., Seoul (KR)

(72) Inventors: Sangjin Park, Seoul (KR); Juhyup Yoon, Seoul (KR); Jin Woo Been, Seoul (KR); Hyunwoo Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 105 days.

(21) Appl. No.: 18/772,404

(22) Filed: Jul. 15, 2024

(65) Prior Publication Data

US 2025/0290647 A1 Sep. 18, 2025

(30) Foreign Application Priority Data

Mar. 13, 2024 (KR) ..... 10-2024-0035320

(51) Int. Cl.
*F24F 3/14* (2006.01)
*F24F 13/20* (2006.01)

(52) U.S. Cl.
CPC ..... *F24F 3/1405* (2013.01); *F24F 13/20* (2013.01); *F24F 2003/1446* (2013.01)

(58) Field of Classification Search
CPC .. F24F 3/1405; F24F 13/20; F24F 2003/1446; F24F 1/0358; F24F 2221/12; F24F 2221/125; B65D 45/025
See application file for complete search history.

(56) References Cited

U.S. PATENT DOCUMENTS

2008/0028776 A1* 2/2008 O'Brien ..... F24F 1/04 62/93
2018/0372347 A1* 12/2018 Carlson ..... F24F 13/30
2020/0187617 A1* 6/2020 Melkebeke ..... A45C 5/146
2020/0270897 A1* 8/2020 Minter ..... E05C 9/10
2021/0189778 A1* 6/2021 Sha ..... E05B 81/76
2021/0396399 A1* 12/2021 Chiu ..... F24F 1/04
2023/0102678 A1* 3/2023 Xing ..... F24F 13/20 62/291

FOREIGN PATENT DOCUMENTS

JP 1994-129665 5/1994

* cited by examiner

*Primary Examiner* — David J Teitelbaum
(74) *Attorney, Agent, or Firm* — KED & ASSOCIATES

(57) ABSTRACT

A dehumidifier is provided that may include a housing including a base, a case disposed on the base, and a top cover that covers an upper end of the case; a dehumidification module provided inside of the housing; and a handle mounted inside of the housing. The dehumidification module may include a compressor that compresses a refrigerant; a fan module; a condenser located at an inlet side of the fan module to condense the refrigerant that has passed through the compressor; an expansion valve that changes a phase of the refrigerant passing through the condenser; and an evaporator located at a rear side the condenser to evaporate the refrigerant that has passed through the expansion valve. The handle may include a front cover; a back cover coupled to a rear side of the front cover; a lifting guide accommodated in a space defined by the front cover and the back cover; a handle body coupled to an upper end of the lifting guide; and a lifting member that provide automatic raising of the handle body.

17 Claims, 15 Drawing Sheets

DEHUMIDIFIER

CROSS-REFERENCE TO RELATED APPLICATION(S)

This application claims the benefits of priority to Korean Patent Application No. 10-2024-0035320, filed in Korea on Mar. 13, 2024, the contents of which is incorporated herein by reference in its entirety.

BACKGROUND

1. Field

A dehumidifier is disclosed herein.

2. Background

A dehumidifier is a device that lowers a humidity in a space in which the dehumidifier is installed by suctioning in air, removing moisture contained in the air, and discharging the dehumidified air back into the room. In general, dehumidifiers are widely used to lower the humidity of indoor air in humid summer or to quickly dry laundry.

Dehumidifiers are divided into a desiccant type and a condensation type depending on a dehumidification method. In the condensation type, a refrigerant cycle is installed inside of the dehumidifier, air suctioned in by a fan passes through an evaporator to condense moisture contained in the air, and then passes through the condenser and is discharged back into a room in a heated state.

A conventional dehumidifier handle is coupled to a dehumidifier body in a tilting or folding manner, so that a user folds the handle and attaches it to a handle groove formed in the main body. In this case, there is a possibility that the handle may be damaged during movement because it is erected by an external force.

BRIEF DESCRIPTION OF THE DRAWINGS

Embodiments will be described in detail with reference to the following drawings in which like reference numerals refer to like elements, and wherein.

DETAILED DESCRIPTION

Hereinafter, a dehumidifier according to an embodiment will be described with reference to the drawings.

Figure 1:
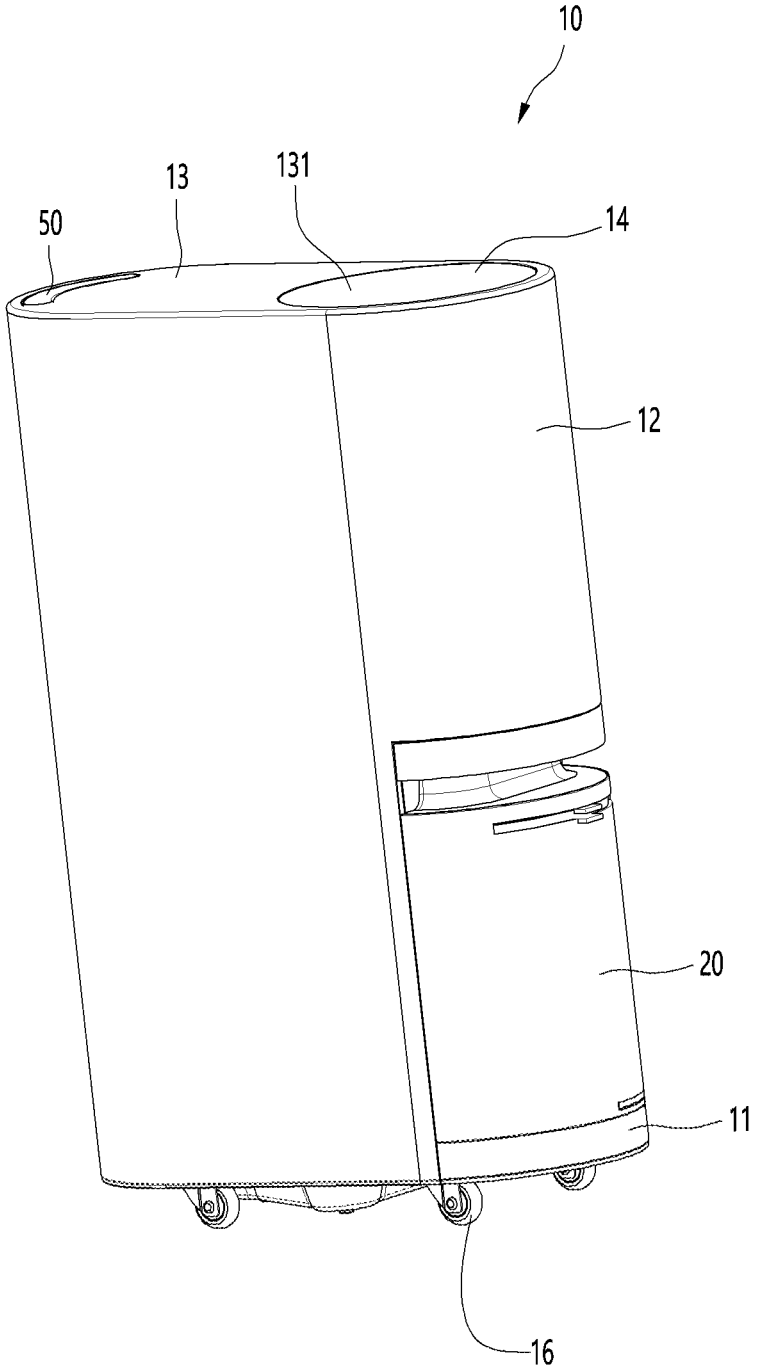
FIG. 1 is a perspective view of a dehumidifier according to an embodiment with a discharge port in a closed state.
Figure 2:
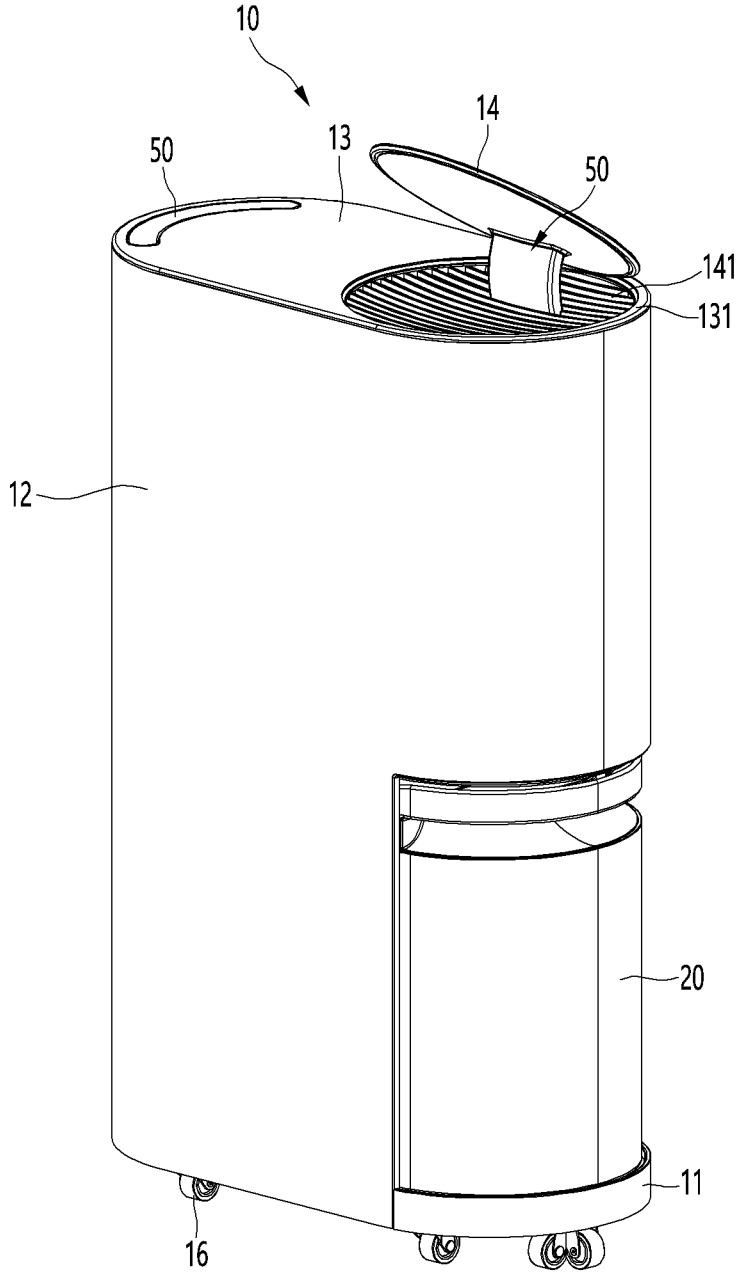
FIG. 2 is a perspective view of the dehumidifier of FIG. 1 with the discharge port in an open state.

FIG. 1 is a perspective view of a dehumidifier according to an embodiment with a discharge port in a closed state. FIG. 2 is a perspective view of the dehumidifier of FIG. 1 with the discharge port open state, and FIG. 3 is a rear perspective view of the dehumidifier of FIG. 1.

Figure 3:
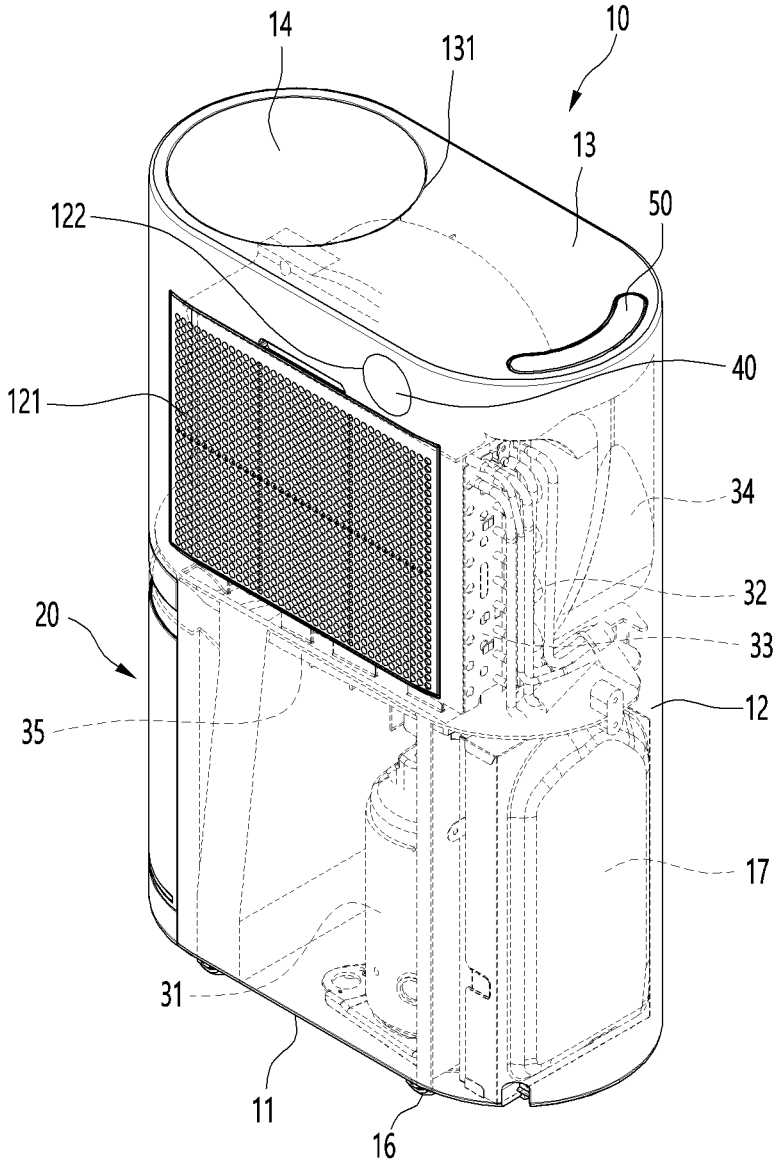
FIG. 3 is a rear perspective view of the dehumidifier of FIG. 1.

Referring to FIGS. 1 to 3, dehumidifier 10 according to an embodiment may have a slim shape with a relatively thin thickness in a frontward-to-backward direction. The dehumidifier 10 may have a thickness extending in the frontward-to-backward direction, a width extending in a leftward-rightward or lateral direction, and a height extending in a vertical direction.

The dehumidifier 10 may include a housing that forms an exterior thereof. The dehumidifier 10 may further include a dehumidification module installed inside of the housing. The dehumidifier 10 may further include a water tank 20 that stores condensate generated during the dehumidification process.

The housing may include a base 11, a case 12, and a top cover 13. The base 11 may form a lower portion of the dehumidifier 10. A plurality of wheels 16 may be mounted on a bottom of the base 11 to facilitate movement of the dehumidifier 10. The case 12 may be disposed on an upper edge of the base 11, and an upper opening of the case 12 may be shielded by the top cover 13.

A suction grill 121 may be formed on a back of the case 12 to intake indoor air. A filter module may be mounted in front of the suction grill 121. The suction grill 121 may be defined as a suction port or inlet through which indoor air is suctioned.

A main discharge port 131, through which dehumidified air may be discharged may be formed on one or a first side of the top cover 13. The main discharge port 131 may be selectively opened or closed by the discharge cover 14.

A handle 50 may be provided on the other or a second side of the top cover 13. The handle 15 has an n-shape so that a vertical portion thereof may be inserted into the case 12 or pulled out from the case 12. When the vertical portion is fully inserted into the case 12, a horizontal portion of the handle 15, that is, an upper surface of a portion configured to be held by a hand, may be flush with the top cover 13.

The main discharge port 131 may be disposed at one or a first edge of the top cover 13. The handle 15 may be placed on the other or a second edge of the top cover 13. The main discharge port 131 and the handle 15 may be located on opposite edges. A discharge grill 141 may be mounted on the main discharge port 131.

A cutout into which the water tank 20 may be inserted may be formed at one edge of the case 12, and the water tank 20 may be detachable from the case 12. When the water tank 20 is mounted on the case 12, an outer surface of the water tank 20 may form a portion of the case 12. The water tank 20 may be located right beneath the main discharge port 131.

The dehumidification module may include a compressor 31 that compresses a refrigerant, a condenser 32 that condenses the refrigerant that has passed through the compressor 31, an expansion valve that expands the refrigerant that has passed through the condenser 32 into a two-phase refrigerant, and an evaporator 33 that evaporates the refrigerant that has passed through the expansion valve. The dehumidification module may further include a fan module 34 that suctions indoor air through the suction grill 121. The evaporator 33 may be located in front of the suction grill 121, the condenser 32 may be located in front of the evaporator 33, and the fan module 34 may be located in front of the condenser 32.

The condenser 32 and the evaporator 33 may be seated on an upper surface of a drain pan 35. Condensed water flowing down from a surface of the evaporator 33 may flow along the drain pan 35 and collected in the water tank 20.

An outlet of the fan module 34 may be connected to the main discharge port 131. The discharge grill 141 may be disposed right above the outlet of the fan module 34.

Indoor air may sequentially pass through the suction grill 121, a filter module, the evaporator 33, and the condenser 32 and then be suctioned into the fan module 34. Air suctioned into the fan module 34 may be discharged through the main discharge port 131.

The air introduced into the case 12 through the suction grill 121 may be dehumidified while passing through the evaporator 33, and moisture contained in the air condensed. As a result, the incoming air becomes low-temperature and dry as it passes through the evaporator 33.

The low-temperature dry air absorbs heat while passing through the condenser 32, and as a result, is changed to a high-temperature dry state and is then discharged back into the room through the main discharge port 131. The term "high temperature air" may refer to air with a temperature slightly higher than a temperature of an indoor space in which the dehumidifier 10 is installed.

A control box 17 may be accommodated inside of the case 12, to control operation of the dehumidification module and various drive means.

A sub discharge port 122 through which dehumidified air may be discharged may be further formed in the case 12. The sub discharge port 122 may be selectively opened or closed by a damper module 40.

When the sub discharge port 122 is open, the main discharge port 131 may be closed, and when the sub discharge port 122 is closed, the main discharge port 131 may be open. Accordingly, the dehumidified air may be selectively discharged only through either the main discharge port 131 or the sub discharge port 122.

The sub discharge port 122 may be formed on a front surface or a rear surface of the case 12. The sub discharge port 122 may be disposed at an upper side of the fan module 34. For example, the sub discharge port 122 may be formed on the rear surface of the case 12 and may be located above the suction grill 121.

The dehumidifier 10 may further include the damper module 40 that selectively opens or closes the sub discharge port 122. The damper module 40 may be installed inside of the sub discharge port 122 and may open or close the sub discharge port 122. The damper module 40 may operate in a direction to close the sub discharge port 122.

A cover drive unit 50 may be mounted on or at the outlet of the fan module 34 to tilt the discharge cover 14 up and down and to rotate the discharge cover 14 in a tilted state clockwise or counterclockwise.

Hereinafter, structure and an operating mechanism of the handle will be described with reference to the drawings.

Figure 4:
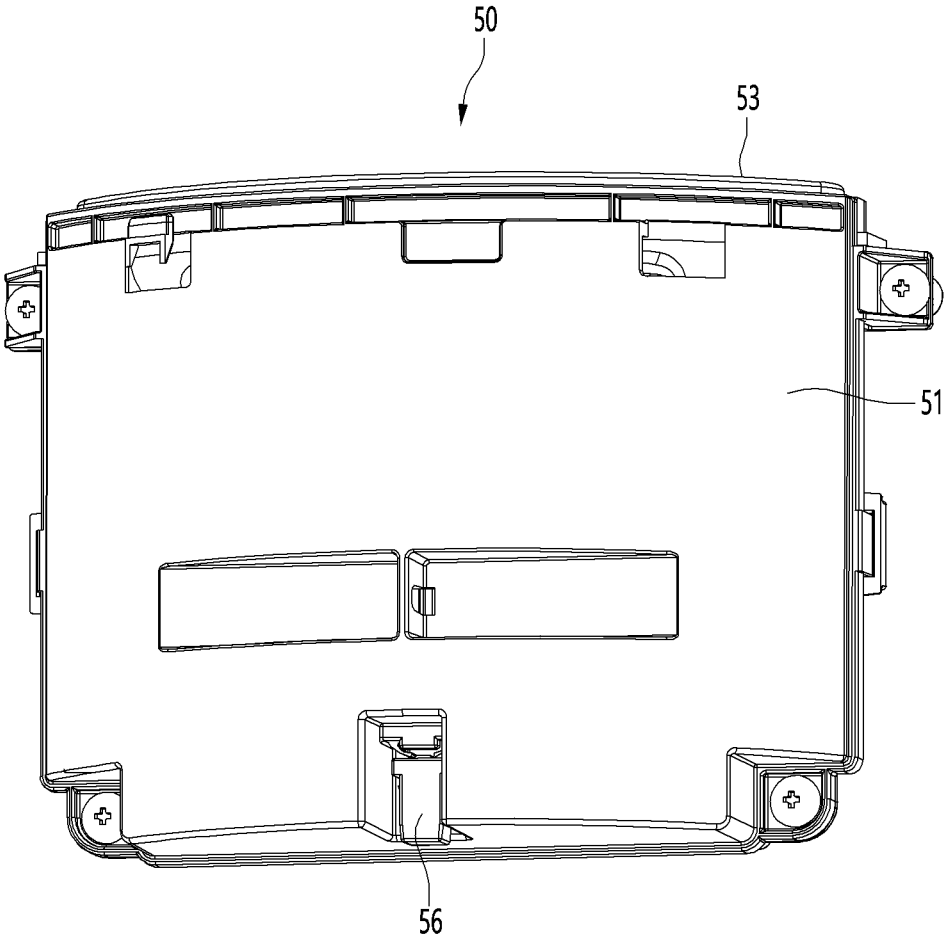
FIG. 4 is a front perspective view of a handle provided in a dehumidifier according to an embodiment.
Figure 5:
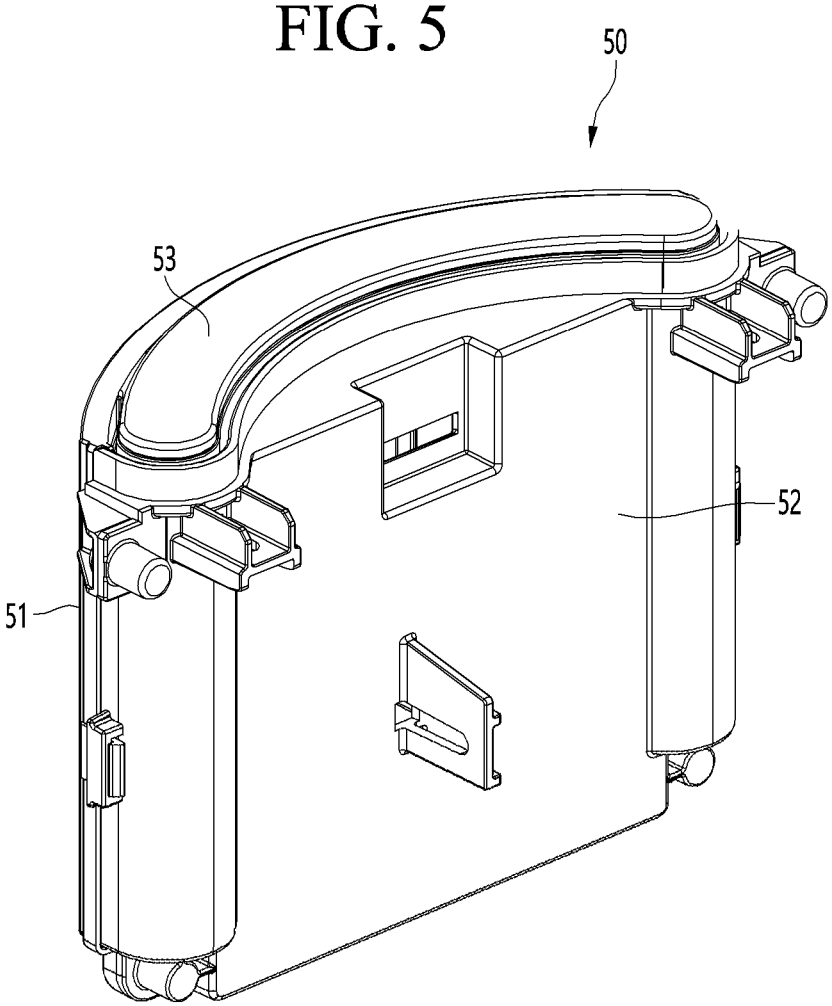
FIG. 5 is a rear perspective view of the handle of FIG. 4.

FIG. 4 is a front perspective view of a handle provided in a dehumidifier according to an embodiment. FIG. 5 is a rear perspective view of the handle of FIG. 5.

Referring to FIGS. 4 and 5, the handle 50 provided in the dehumidifier 10 according to an embodiment may be designed to be rounded with a predetermined curvature to match a side contour of the case 12.

The handle 50 may include a front cover 51, a back cover 52 coupled to a rear side of the front cover 51, a handle body 53 configured to be drawn out from an internal space formed by a coupling of the front cover 51 and the back cover 52, and a lifting member that enables the handle body 53 to be raised and lowered.

A latch 56 may be installed on a lower front center portion of the front cover 51. The latch 56 may be fixed to the front cover 51 or may be fixed to a component of the humidifier other than the front cover 51.

Figure 6:
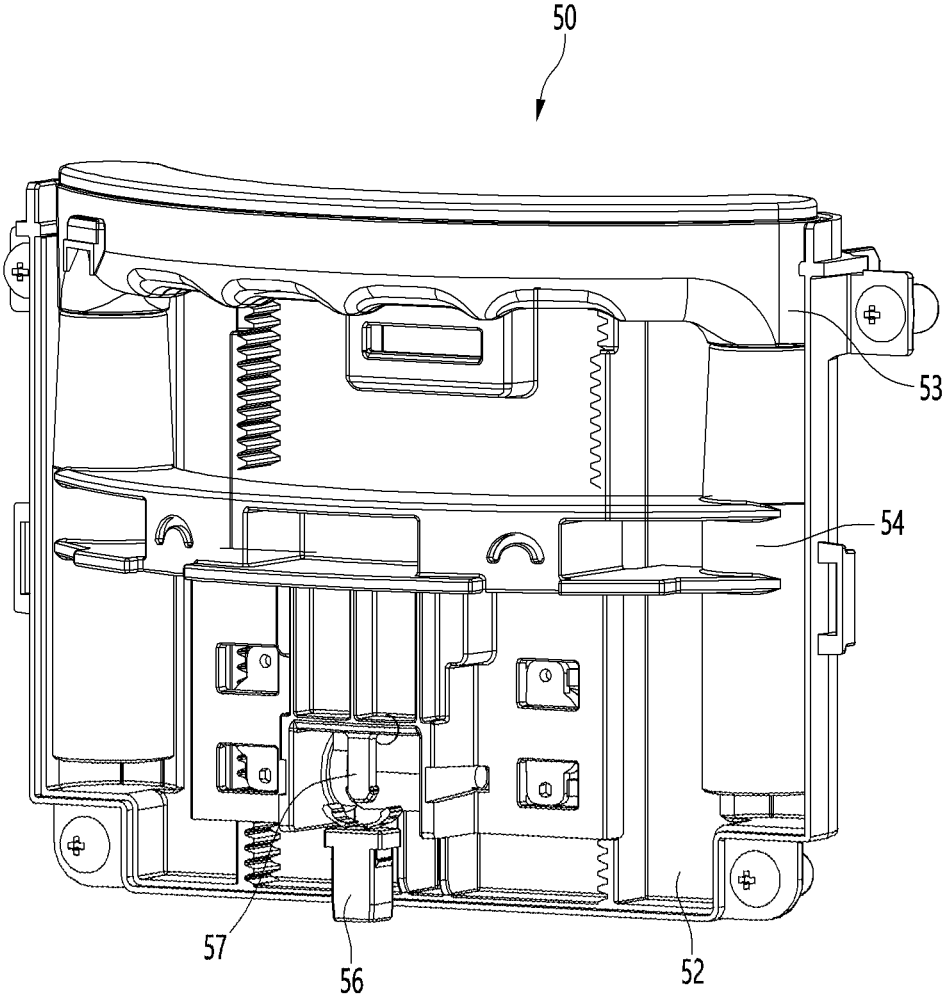
FIG. 6 is a perspective view of the handle of FIG. 4 with a front cover removed.
Figure 7:
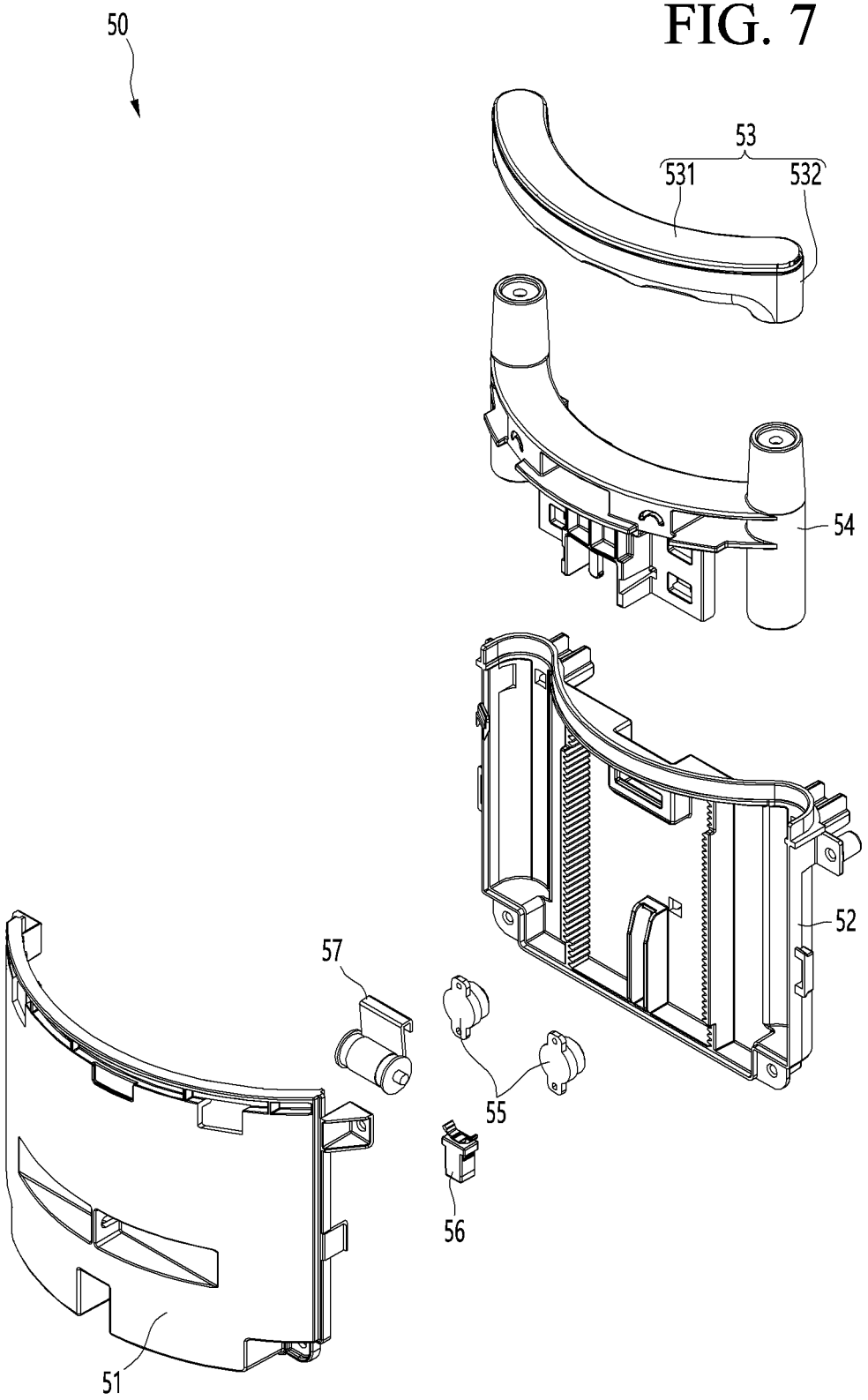
FIG. 7 is an exploded perspective view of the handle of FIG. 4.

FIG. 6 is a perspective view of the handle of FIG. 4 with the front cover removed. FIG. 7 is an exploded perspective view of the handle of FIG. 4.

Referring to FIGS. 6 and 7, the handle 50 may further include a lifting guide 54. The handle body 53 may be coupled to an upper end of the lifting guide 54. The lifting guide 54 may be provided to be vertically movable in a space formed by the front cover 51 and the back cover 52.

In addition, the handle 50 may further include a speed control means that controls a lifting speed of the lifting guide 54. The speed control means may include a lock spring 57 and a reduction gear 55. The lock spring 57 and the reduction gear 55 may perform a function of suppressing or preventing rapid elevation of the lifting guide 54. The reduction gear 55 may be provided on or at left and right or lateral sides of the lock spring 57, respectively.

The handle body 53 may include a grip portion (grip) 531 that a user may hold with his or her hand, and an extension portion 532 that extends downward from both ends of the grip portion 531. The extension portion 532 may be coupled to an upper end of the lifting guide 54. When the handle body 53 is not used, the handle body 53 may be inserted into the space formed by the front cover 51 and the back cover 52, so that an upper surface of the grip portion 531 and an upper surface of the top cover 13 are coplanar to each other.

Figure 8:
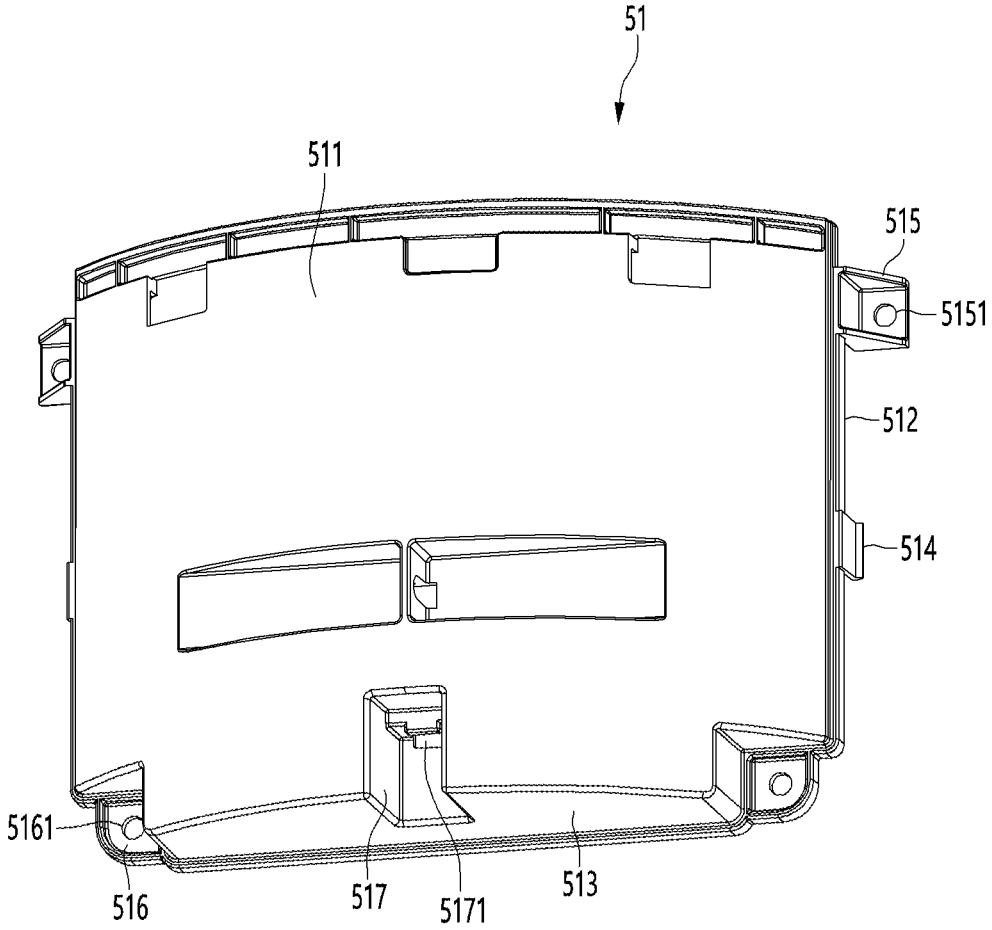
FIG. 8 is a front perspective view of the front cover of a handle according to an embodiment.

FIG. 8 is a front perspective view of a front cover of the handle according to an embodiment. Referring to FIG. 8, the front cover 51 of the handle 50 according to an embodiment may include a front portion 511, a pair of side portions 512, and a bottom portion 513. An upper surface of the front cover 51 may be selectively shielded by the grip portion 531 of the handle body 53.

The front portion 511 may be curved with a predetermined curvature depending on a shape of the case 12, but is not limited to this and may be formed flat depending on an installation location. One or more fastening flanges 515 and fastening hooks 514 may extend from each of the pair of side portions 512, and a fastening hole 5151 may be formed in the fastening flange 515. The fastening flange 515 may extend in a lateral direction crossing the side portion 512, and the fastening hook 514 may extend rearward from the side portion 512.

Fastening flanges 516 may be respectively formed at left and right or lateral lower corners of the front portion 511. Fastening holes 5161 may be formed in the fastening flanges 516.

A latch receiving portion 517 may be recessed to a predetermined depth at a bottom center of the front portion 511. The latch 56 may be accommodated in the latch receiving portion 517. A latch hook through hole 5171 may be formed in an upper surface of the latch receiving portion 517.

Figure 9:
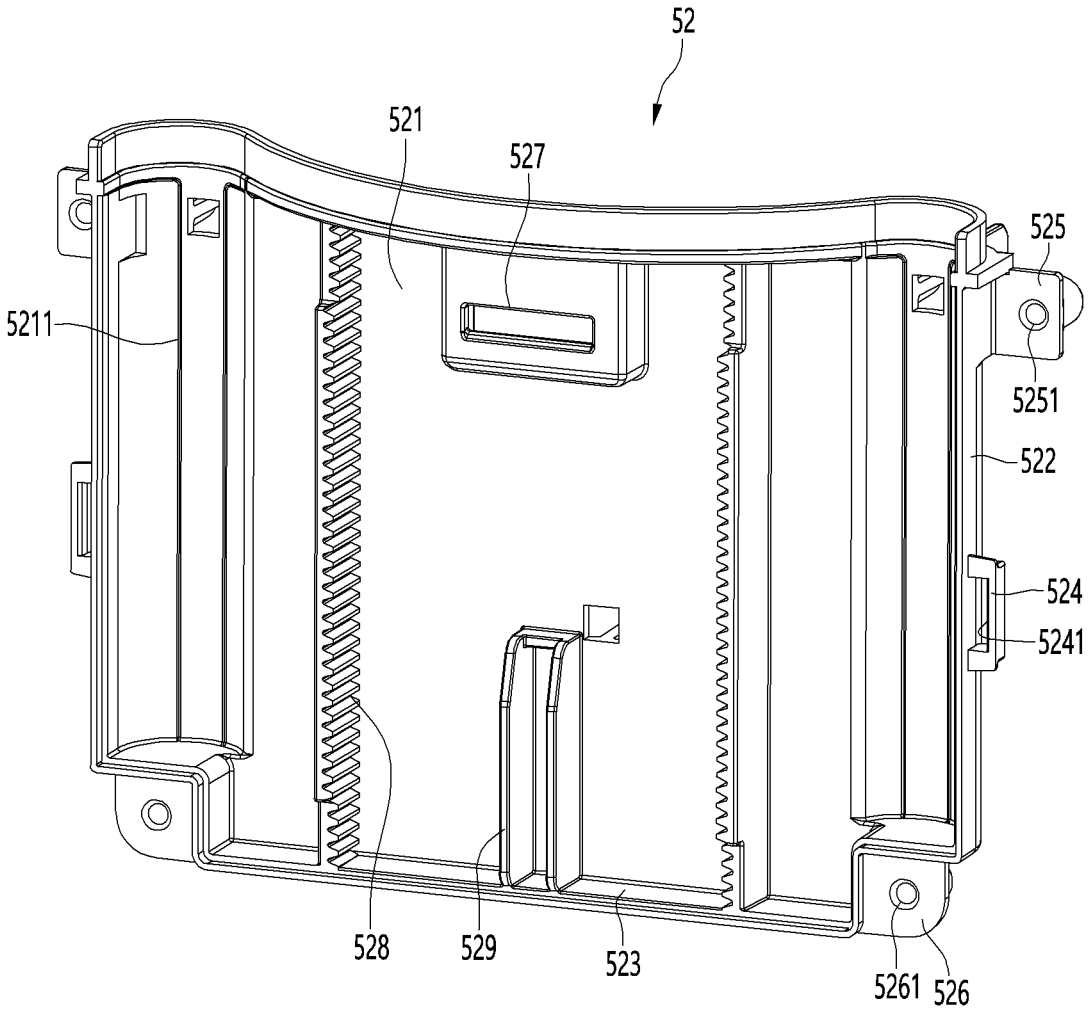
FIG. 9 is a front perspective view of the back cover of a handle according to an embodiment.

FIG. 9 is a front perspective view of a back cover of the handle according to an embodiment. Referring to FIG. 9, the back cover 52 of the handle 50 according to an embodiment may include a front portion 521, a pair of side portions 522, and a bottom portion 523.

An upper surface of the back cover 52 may also be opened like the upper surface of the front cover 51, and may be opened or closed by the grip portion 531. Additionally, the front portion 521 of the back cover 52 may also be curved to a predetermined curvature like the front portion 511 of the front cover 51.

A lock spring locking hole 527 may be formed at an upper center of the front portion 521. A lock spring support rib 529 may protrude at a lower center of the front portion 521.

In addition, rack gears 528 may be respectively formed on left and right or lateral sides of a vertical line that bisects the front portion 521, and the rack gears 528 may extend from a top to a bottom of the front portion 521. The reduction gear 55 may be engaged with the rack gear 528. The reduction gear 55 may be defined as a pinion equipped with a damping function. That is, when the lock spring 527 is wound by an elastic force, the reduction gear 55 functions to limit the speed at which the lifting guide 54 is elevated.

At left and right or lateral edges of the front portion 521, lifting pole seating portions 5211, on which lifting poles 541 of the lifting guide 54 (see FIG. 10) may be seated, may be formed to be recessed.

Additionally, a fastening flange 525 corresponding to a fastening flange 515 formed on the front cover 51 may be formed on the side portion 522, and a fastening hole 5251 may be formed in the fastening flange 525. In addition, a fastening end 524 to which the fastening hook 514 of the front cover 51 may be coupled may be formed on the side portion 522, and a hook hole 5241 to which an end of the fastening hook 524 may be caught may be formed at the fastening end 524.

A fastening flange 526 corresponding to the fastening flange 516 of the front cover 51 may be formed at each of left and right or lateral lower corners of the front portion 521, and a fastening hole 5261 may be formed in the fastening flange 526.

Figure 10:
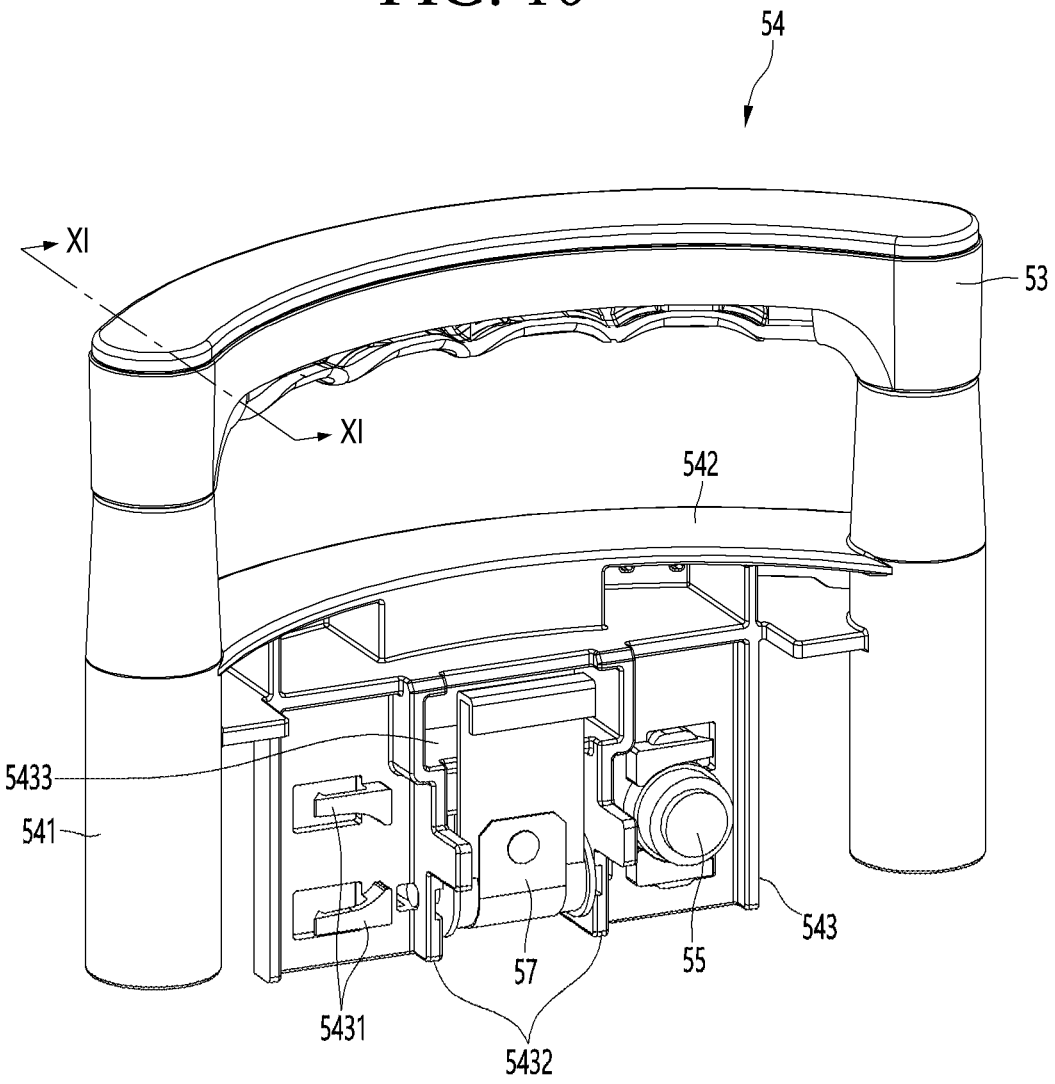
FIG. 10 is a rear perspective view of a lifting guide of the handle according to an embodiment.
Figure 11:
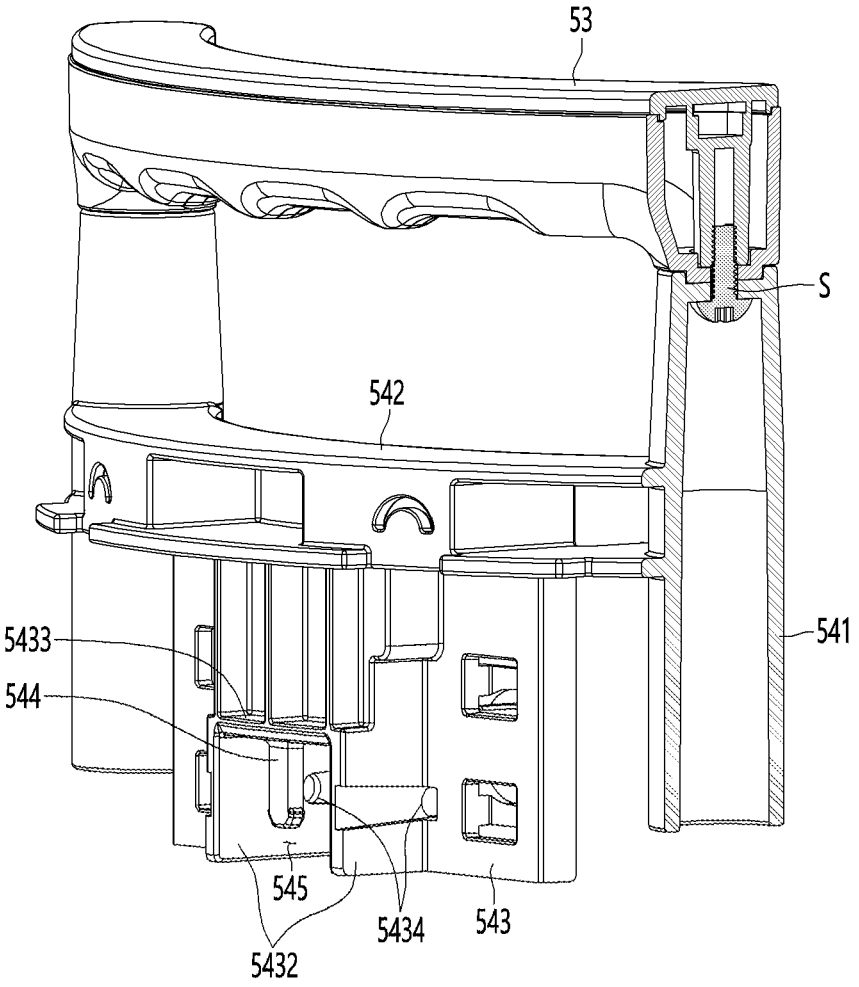
FIG. 11 is a front cut-away perspective view of the lifting guide, taken along line XI-XI in FIG. 10.

FIG. 10 is a rear perspective view of a lifting guide of the handle according to an embodiment. FIG. 11 is a front cut perspective view of the lifting guide, taken along XI-XI in FIG. 10.

Referring to FIGS. 10 and 11, the lifting guide 54 of the handle 50 according to an embodiment may be lifted and lowered inside of the space formed by the front cover 51 and the back cover 52. The handle body 53 may be coupled to an upper end of the lifting guide 54 and move up and down singularly with the lifting guide 54.

The lifting guide 54 may include a pair of lifting poles 541, a connection bridge 542 that connects the pair of lifting poles 541, and a guide center 543 that extends from a bottom of the connecting bridge 542. The pair of lifting poles 541 and the connecting bridge 542 may form an H shape. In addition, the extension portion 532 of the handle body 53 may be coupled to the upper end of the pair of lifting poles 541 by a fastening member S.

Gear support ribs 5431 may be formed on rear left and right or lateral sides of the guide center 543, respectively. The reduction gear 55 may be disposed and supported on each of a pair of gear support ribs 5431. The gear support ribs 5431 may extend rearward from a rear surface of the guide center 543 and may be bent laterally, and the reduction gear 55 may be inserted into a space defined between the rear surface of the guide center 543 and the gear support rib 5431 that is bent laterally. Then, gear teeth of the reduction gear 55 may be engaged with the rack gear 528.

In addition, a pair of lock spring support ribs 5432 may extend from a center of the guide center 543. The reduction gear 55 may be coupled at a point between a left or first side one of the pair of lock spring support ribs 5432 and a left or first edge of the guide center 543, and a point between a right or second side one of the pair of lock spring support ribs 5432 and a right or second edge of the guide center 543, respectively. A rear surface of the reduction gear 55 may be supported by the gear support rib 5431.

In addition, the lock spring 57 may be received in the lock spring receiving portion 545 which may be defined by the pair of lock spring support ribs 5432 and the connection rib 5433. A hinge hole 5434 may be formed in each of the pair of lock spring support ribs 5432.

Additionally, a latch hook 544 may extend downward by a predetermined length from a bottom of a connecting rib 5433 and be selectively coupled to the latch 56. The latch hook 544 and latch 56 may be defined as a push-pull switch. That is, when a user lowers the grip portion 531 to a maximum, the latch hook 544 may be coupled to the latch 56. In this state, the latch hook 544 may be separated from the latch 56 by the motion that the grip portion 531 is pressed and released.

Figure 12:
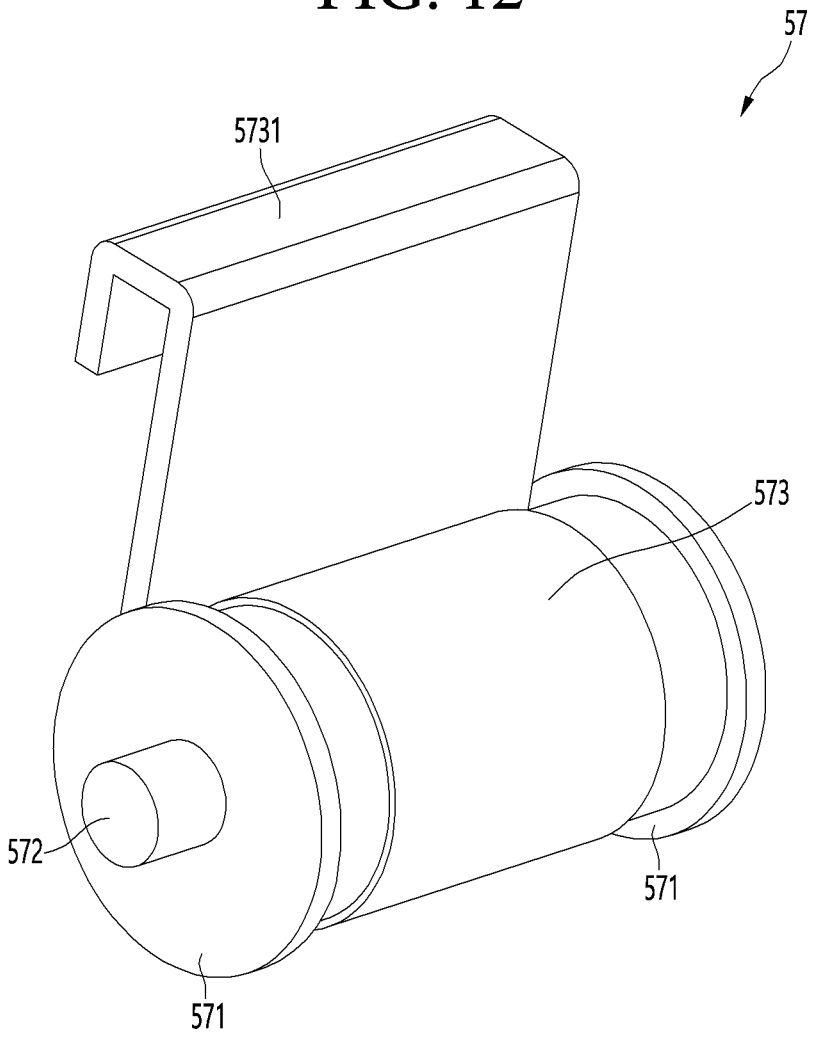
FIG. 12 is a front perspective view of a lock spring of the handle according to an embodiment.
Figure 13:
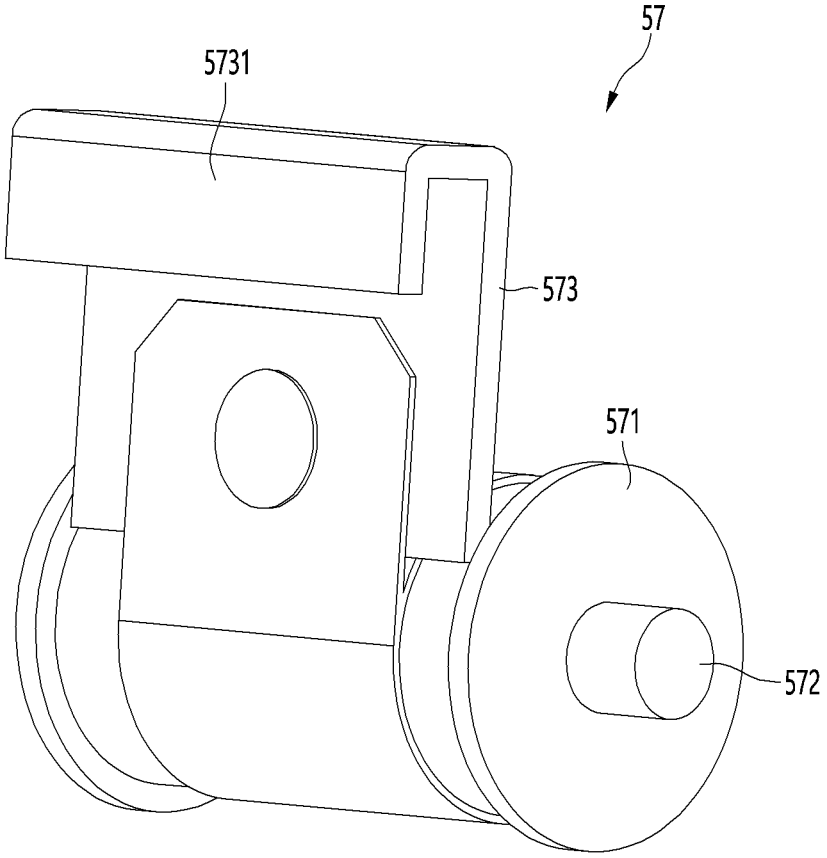
FIG. 13 is a rear perspective view of the lock spring of FIG. 12.

FIG. 12 is a front perspective view of a lock spring of the handle according to an embodiment. FIG. 13 is a rear perspective view of the lock spring of FIG. 12.

Referring to FIGS. 12 and 13, the lock spring 57 of the handle 50 according to an embodiment may be a speed control means that controls a rising speed of the lifting guide 54, together with the reduction gear 55.

The lock spring 57 may include an elastic portion 573 in the form of a spiral spring that extends to a predetermined length, a frame 571 around which the elastic portion 573 is wound, and an that extends hinge shaft 572 that extends from both side surfaces of the frame 571. The frame 571 may include a cylindrical body around which the elastic portion 573 is wound, and disk-shaped support plates provided at both ends of the body. The hinge shaft 572 may be positioned at a center of an outer surface of the support plate. The hinge shaft 572 may be inserted into the hinge hole 5434 formed in the lock spring support rib 5432 of the lifting guide 54 to function as a rotational center of the frame 571.

Additionally, one or a first end of the elastic portion 573 may be fixed to a body of the frame 571, and the other or a second end may be bent multiple times to form a locking portion 5731. The locking portion 5731 may be caught in the lock spring locking hole 527 formed at a front center of the back cover 52.

Figure 14:
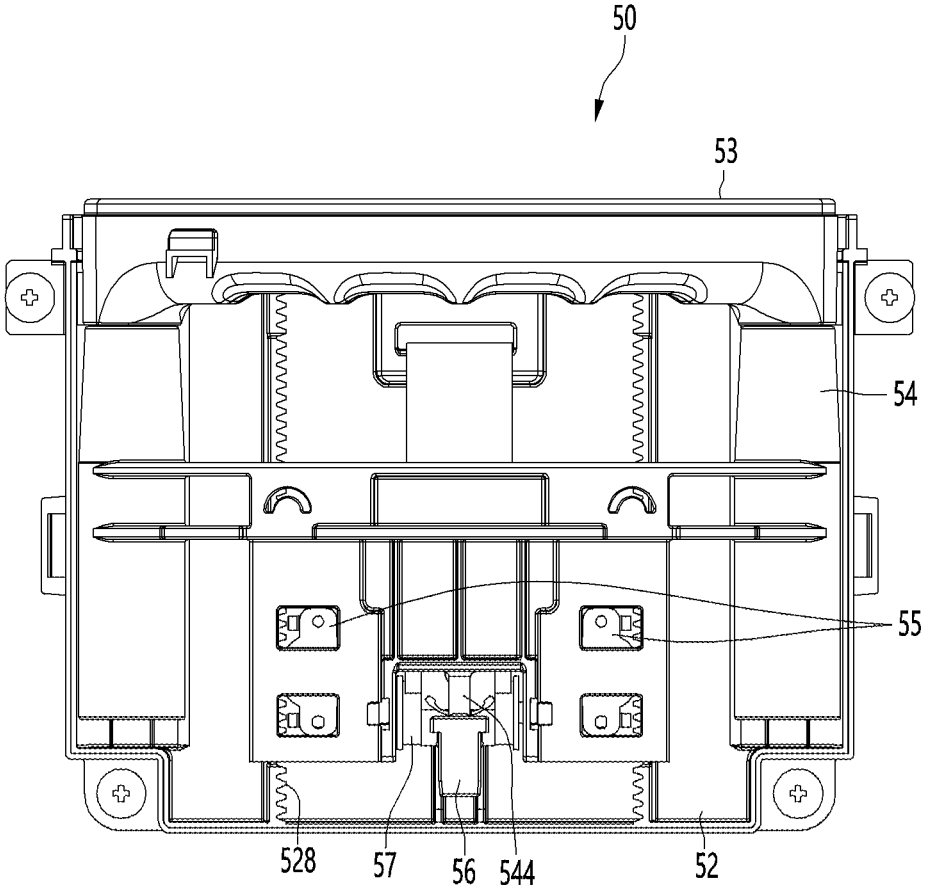
FIG. 14 is a view showing the handle in an unused state.
Figure 15:
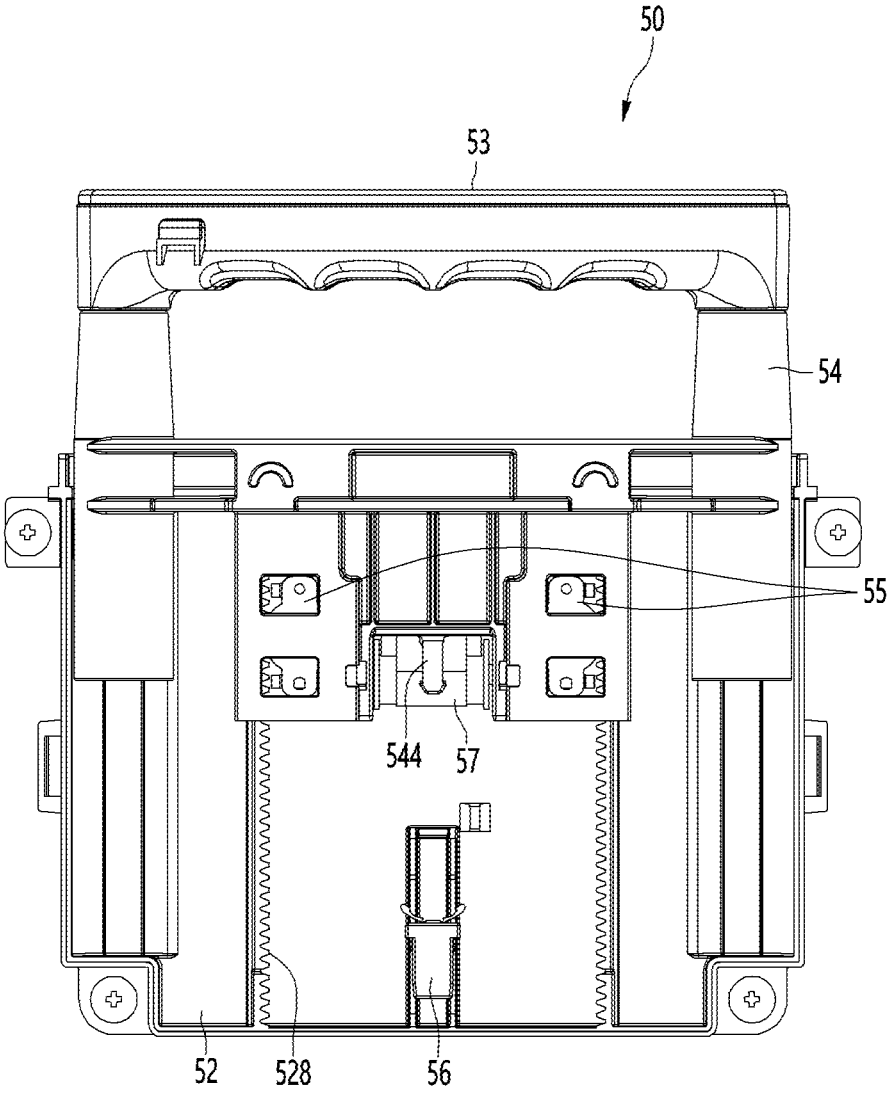
FIG. 15 shows the handle in use.

FIG. 14 is a view showing the handle in an unused state. FIG. 15 is a view showing the handle in a used state.

Referring to FIG. 14, when the handle 50 is not in use, the handle body 53 may be inserted into the handle 50, then the upper surface of the grip portion 531 forms a same plane as the upper surface of the top cover 13. In this state, the lifting guide 54 is lowered to the maximum, and the latch hook 544 is maintained coupled to the latch 56. At the same time, the elastic portion 573 is released from the frame 571 and maintained in a fully extended state.

Referring to FIG. 15, in a state in which the upper surface of the grip portion 531 forms the same surface as the upper surface of the top cover 13, when a user applies force to press and release the upper surface of the grip portion 531, the latch hook 544 is separated from the latch 56. At the same time, the elastic portion 573 is wound around the frame 571 by a restoring force of the elastic portion 573, and as a result, the lifting guide 54 to which the lock spring 57 is coupled rises. When the lifting guide 54 rises, the reduction gear 55 is engaged with the rack gear 528 while rising, to allow the lifting guide 54 to rise gradually rather than to jump up sharply. Then, the lifting guide 54 rises until the connecting bridge 542 of the lifting guide 54 touches the bottom of the top cover 13.

In this way, the handle body 53 protrudes above the top cover 13 just by the motion that the user lightly pressing and releasing the grip portion 531, and when not in use, the grip portion 531 may be pushed down to be inserted into the case 12, thereby allowing a convenience of use to be improved.

Embodiments disclosed herein provide a dehumidifier that may include a housing including a base, a case disposed on an edge of the base, and a top cover that covers an upper end of the case; a dehumidification module provided inside of the housing; and a handle mounted inside of the housing. The dehumidification module may include a compressor that compresses a refrigerant; a fan module; a condenser located on or at an inlet side of the fan module to condense a refrigerant that has passed through the compressor; an expansion valve that changes a phase of the refrigerant passing through the condenser; and an evaporator located on or at a rear side of the condenser to evaporate the refrigerant that has passed through the expansion valve. The handle may include a front cover; a back cover coupled to a rear side of the front cover; a lifting guide accommodated in a space defined by the front cover and the back cover; a handle body coupled to an upper end of the lifting guide; and a lifting member that allows automatic raising of the handle.

The lifting member may include a latch hook formed on the lifting guide; a latch to which the latch hook is selectively coupled; a lock spring that connects the lifting guide and the back cover to generate a force to raise the lifting guide; and reduction gears that reduce a rising speed of the lifting guide. The lock spring may include a frame with hinge shafts that extend at both ends thereof, an elastic portion in the shape of spiral spring one or a first end of which is fixed and wound to the frame. The hinge shaft may be rotatably coupled to the lifting guide, and the other or a second end of the elastic portion may be hooked to the back cover.

When the lifting guide is lowered in the space and the latch hook is coupled to the latch, the elastic portion may be released from the frame to accumulate a restoring force, and an upper surface of the handle may be coplanar to the top cover. When a force to press and release the upper surface of the handle is applied to the handle, the latch hook is separated from the latch, and the elastic portion is wound around the frame and the lifting guide is raised by the restoring force of the elastic portion.

At least one rack gear may be formed on a front surface of the back cover and extend vertically. The reduction gear may be coupled to a rear surface of the lifting guide in a state of engagement with the rack gear, and when the lifting guide rises, the reduction gear may be configured to decelerate the lifting guide while moving up along the rack gear.

The lifting guide may include a pair of lifting poles that vertically extend in parallel to each other, a connection bridge that connects the pair of lifting poles; and a guide center that extends below the connection bridge. The lifting guide may be configured to rise until it touches a bottom of the top cover.

The frame of the lock spring may be rotatably coupled to the guide center. The reduction gears may be respectively coupled to rear surfaces of the guide center corresponding to left and right sides of the lock spring.

The dehumidifier according to embodiments disclosed herein may have at least the following advantages.

Firstly, the grip portion that constitutes the handle may be inserted into the main body when not in use and is not exposed to an outside, thereby having the advantage of giving the dehumidifier a neat appearance.

Secondly, as the handle body does not protrude outward when not in use, damage to the handle body due to an external force is prevented.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A dehumidifier, comprising:
- a housing including a base, a case disposed on the base, and a top cover that covers an upper end of the case;
- a dehumidification module provided inside of the housing; and
- a handle mounted inside of the housing, wherein the dehumidification module includes:
  - a compressor that compresses a refrigerant;
  - a fan module;
  - a condenser located at an inlet side of the fan module to condense the refrigerant that has passed through the compressor;
  - an expansion valve that changes a phase of the refrigerant passing through the condenser; and
  - an evaporator located at a rear side the condenser to evaporate the refrigerant that has passed through the expansion valve, and wherein the handle includes:
    - a front cover;
    - a back cover coupled to a rear side of the front cover;
    - a lifting guide accommodated in a space defined by the front cover and the back cover;
    - a handle body coupled to an upper end of the lifting guide; and
    - a lifting device that provides automatic raising of the handle body.

2. The dehumidifier according to claim 1, wherein the lifting device includes:
- a latch hook formed on the lifting guide;
- a latch to which the latch hook is selectively coupled;
- a lock spring that connects the lifting guide and the back cover to generate a force to raise the lifting guide; and
- reduction gears that reduce a rising speed of the lifting guide.

3. The dehumidifier according to claim 2, wherein the lock spring includes:
- a frame with hinge shafts that extend at both ends thereof, and an elastic portion in a shape of a spiral spring, wherein a first end of the elastic portion is fixed and wound to the frame, wherein the hinge shafts are rotatably coupled to the lifting guide, and wherein a second end of the elastic portion is hooked to the back cover.

4. The dehumidifier according to claim 3, wherein when the lifting guide is lowered in the space and the latch hook is coupled to the latch, the elastic portion is released from the frame to accumulate a restoring force, and an upper surface of the handle is coplanar to the top cover.

5. The dehumidifier according to claim 4, wherein when a force to press and release the upper surface of the handle body is applied to the handle body, the latch hook is separated from the latch, and the elastic portion is wound around the frame and the lifting guide is raised by the restoring force of the elastic portion.

6. The dehumidifier according to claim 5, wherein at least one rack gear is formed on a front surface of the back cover and extends vertically, wherein the at least one of the reduction gears is coupled to a rear surface of the lifting guide in a state of engagement with the at least one rack gear, and wherein when the lifting guide rises, the at least one reduction gear is configured to decelerate the lifting guide while moving up along the at least one rack gear.

7. The dehumidifier according to claim 6, wherein the lifting guide includes:
- a pair of lifting poles that vertically extend in parallel to each other;
- a connection bridge that connects the pair of lifting poles; and
- a guide center that extends below the connection bridge, and wherein the lifting guide is configured to rise until the lifting guide touches a bottom of the top cover.

8. The dehumidifier according to claim 7, wherein the frame of the lock spring is rotatably coupled to the guide center, and wherein the reduction gears are respectively coupled to rear surfaces of the guide center corresponding to lateral sides of the lock spring.

9. The dehumidifier according to claim 1, wherein when the handle is mounted inside of the housing, a top surface of the handle body is configured to be flush with a top surface of the top cover.

10. A dehumidifier, comprising:
- a housing;
- a dehumidification module provided inside of the housing; and
- a handle mounted inside of the housing, wherein the dehumidification module includes:
  - a compressor that compresses a refrigerant;
  - a fan module;
  - a condenser located at an inlet side of the fan module to condense the refrigerant that has passed through the compressor;
  - an expansion valve that changes a phase of the refrigerant passing through the condenser; and
  - an evaporator located at a rear side the condenser to evaporate the refrigerant that has passed through the expansion valve, and wherein the handle includes:
    - a front cover;
    - a back cover coupled to the front cover;
    - a lifting guide accommodated in a space defined by the front cover and the back cover;
    - a handle body coupled to an upper end of the lifting guide; and
    - a lifting device that provides automatic raising of the handle body, wherein the lifting device includes:
      - a latch hook formed on the lifting guide;

a latch to which the latch hook is selectively coupled;

a lock spring that connects the lifting guide and the back cover to generate a force to raise the lifting guide; and reduction gears that reduce a rising speed of the lifting guide.

11. The dehumidifier according to claim 10, wherein the lock spring includes:

a frame with hinge shafts that extend at both ends thereof, and an elastic portion in a shape of a spiral spring, wherein a first end of the elastic portion is fixed and wound to the frame, wherein the hinge shafts are rotatably coupled to the lifting guide, and wherein a second end of the elastic portion is hooked to the back cover.

12. The dehumidifier according to claim 11, wherein when the lifting guide is lowered in the space and the latch hook is coupled to the latch, the elastic portion is released from the frame to accumulate a restoring force, and an upper surface of the handle is coplanar to the top cover.

13. The dehumidifier according to claim 12, wherein when a force to press and release the upper surface of the handle body is applied to the handle body, the latch hook is separated from the latch, and the elastic portion is wound around the frame and the lifting guide is raised by the restoring force of the elastic portion.

14. The dehumidifier according to claim 13, wherein at least one rack gear is formed on a front surface of the back cover and extends vertically, wherein the at least one of the reduction gears is coupled to a rear surface of the lifting guide in a state of engagement with the at least one rack gear, and wherein when the lifting guide rises, the at least one reduction gear is configured to decelerate the lifting guide while moving up along the at least one rack gear.

15. The dehumidifier according to claim 14, wherein the lifting guide includes:

a pair of lifting poles that vertically extend in parallel to each other;

a connection bridge that connects the pair of lifting poles; and a guide center that extends below the connection bridge, and wherein the lifting guide is configured to rise until the lifting guide touches a bottom of the top cover.

16. The dehumidifier according to claim 15, wherein the frame of the lock spring is rotatably coupled to the guide center, and wherein the reduction gears are respectively coupled to rear surfaces of the guide center corresponding to lateral sides of the lock spring.

17. The dehumidifier according to claim 10, wherein when the handle is mounted inside of the housing, a top surface of the handle body is configured to be flush with a top surface of the case.

* * * * *